US010137343B2

(12) United States Patent
Zeidan

(10) Patent No.: US 10,137,343 B2
(45) Date of Patent: Nov. 27, 2018

(54) GOLF BALL ELEVATOR WITH FLAGSTICK AND MEDIA DISPLAY

(71) Applicant: Numan Zeidan, Hillsborough, CA (US)

(72) Inventor: Numan Zeidan, Hillsborough, CA (US)

( * ) Notice: Subject to any disclaimer, the term of this patent is extended or adjusted under 35 U.S.C. 154(b) by 0 days.

(21) Appl. No.: 15/411,950

(22) Filed: Jan. 20, 2017

(65) Prior Publication Data

US 2018/0207496 A1 Jul. 26, 2018

(51) Int. Cl.
*A63B 57/40* (2015.01)

(52) U.S. Cl.
CPC ..... *A63B 57/405* (2015.10)

(58) Field of Classification Search
CPC ..... A63B 57/405
See application file for complete search history.

(56) References Cited

U.S. PATENT DOCUMENTS 3,623,732 A * 11/1971 Peeples ..... A63B 57/405 473/178
4,236,162 A * 11/1980 Carolus ..... H01Q 1/103 242/390.3
5,042,866 A * 8/1991 Cody ..... B60J 1/2019 296/141
5,674,131 A * 10/1997 Forbes ..... A63B 57/405 473/177
5,959,593 A * 9/1999 Hoshi ..... H01Q 1/10 343/711

FOREIGN PATENT DOCUMENTS

GB 2403156 A * 12/2004 ..... A63B 57/405
WO WO 2007/011159 A1 * 1/2007 ..... A63B 57/405

* cited by examiner

*Primary Examiner* — John E Simms, Jr.
(74) *Attorney, Agent, or Firm* — William C. Milks, III

(57) ABSTRACT

A golf ball elevator facilitates retrieval of a golf ball by a golfer after the golfer strokes the golf ball into a golf hole cup on a putting green of a golf course.

19 Claims, 5 Drawing Sheets

GOLF BALL ELEVATOR WITH FLAGSTICK AND MEDIA DISPLAY

BACKGROUND OF THE INVENTION

1. Field of the Invention

The present invention relates to the field of the athletic game of golf. Generally, the present invention relates to the configuration of a golf course on which a round of golf is played, and, more particularly, to the installation of golf hole cups on the putting greens of a golf course. Specifically, the present invention provides a golf hole cup to replace conventional golf hole cups, which comprises a golf ball elevator for returning a golf ball to a golfer after successfully stroking his or her golf ball into the hole.

2. Description of the Prior Art

Typically, holes on the greens of a golf course are provided by digging a cylindrical hole and installing a golf hole cup in the hole. FIGS. 1 and 2 illustrate a typical United States Golf Association (USGA) approved standard golf course flag assembly 10 inserted into a conventional USGA golf hole cup 20. Although USGA regulation flagsticks and golf hole cups are chosen to illustrate an embodiment of the present invention, it will be apparent to persons skilled in the art that the present invention may be adapted for use with other non-conforming flagstick and golf hole cup assemblies. The present invention is not limited to the specific applications described herein, or to USGA-specified dimensions and materials.

As shown in FIG. 1, a straight cylindrical flagstick 12 has a metallic cylindrical projection "ferrule" 16 attached to its base. As illustrated in FIG. 2, the bottom of the cup 20 has a "webbing" structure, wherein a center cylindrical aperture 22 is formed for reception of the ferrule 16 by web elements 27, the web elements projecting from an inner cylindrical cup wall 29. In between the web elements 27, voids 25 are formed, which allow dirt and water to pass through the bottom of the cup 20, as is well known in the art. The ferrule 16 slides into and out of the aperture 22, enabling a golfer to remove or replace the flag assembly 10. The top of the flagstick 12 typically has a flexible flag 36 attached thereto, in order to provide increased visibility of the location of a golf hole 11 on a golf course putting green.

The cup 20 is cylindrical, with an outside radius 28, and is customarily inserted into the ground G until the top rim 50 of the cup is a distance 52 below the putting surface S of the golf course putting green, producing an earthen hole rim 54 at the top of the hole 11. USGA regulations specify that the distance 52 is about 1.5 inches, which is therefore also the height of earthen hole rim 54. The ferrule 16 is inserted into the aperture 22 until a ferrule collar 19 engages a cup aperture rim 26. When inserted into the aperture 22, ferrule side elements 18 engage the inside surface 24 of the aperture 22. The aperture inside surface 24 is defined about a radius 30 aligned with the outside radius 28 of the cup 20. The ferrule side elements 18 are similarly defined substantially about a radius 32, which is aligned normal to the cylindrical flagstick 12 centerline C.

The ferrule side element radius 32 is slightly smaller than the aperture radius 30, thereby enabling easy insertion and removal by a golfer of the ferrule 16 from the aperture 22. By engaging the ferrule side elements 18 with the aperture inside surface 24, and the ferrule collar 19 with the cup aperture rim 26, the cup 20 holds the flagstick 12 in a vertical fashion, with the flagstick centerline C substantially normal to the cup 20 radius 28.

The flagstick 12 is typically fiberglass, with popular outside diameter dimensions of ½ or ⅝ inch. Fiberglass flagsticks 12 of these dimensions are preferred by most golf courses since they are lightweight, durable, and rigid.

A golfer may stroke his or her golf ball into the cup 20 while be or she is off the putting green when the flagstick 12 is in the cup. It is important that the flagstick 12 allows a golf ball to fall into the cup 20 while the flagstick is still inserted into the cup 20. With a typical inside diameter 40 of about 4.25 inches, a conventional USGA cup 20 has space within the golf ball engaging area 42 within the cup to accommodate the flagstick 12 and allow a USGA regulation golf ball to fall into the cup. On the other hand, if the golfer has stroked his or her golf ball onto the putting green without entering the cup 20, the flagstick 12 is typically removed from the cup, and the golfer putts his or her golf ball one or more times until the ball falls into the cup.

In either case, in order for the golfer to retrieve his or her golf ball after stroking the ball into the cup 20, the golfer typically bends down and plucks the ball out of the cup by hand. Often, the golfer stands over the hole 11 on one leg, with his or her other leg lifted off the putting green and extended behind the golfer for balance as the golfer bends and reaches into the cup 20 to retrieve his or her golf ball. Such a maneuver may be a difficult task for many golfers and increases the risk of the golfer losing his or her balance and staggering, or even falling down. Also, bending over by arching the spine during the process of removing the golf ball from the cup 20 is uncomfortable for some golfers, especially those with back problems.

SUMMARY OF THE INVENTION

The present invention has as an object to provide a device to facilitate the retrieval of a golf ball after the ball is stroked by a golfer into a golf hole cup. Various examples of the device in accordance with the present invention provide a golf ball elevator incorporated into a golf hole cup to return the golf ball to the golfer after the ball falls into the cup so that the golfer does not need to bend over to retrieve his or her ball, thereby avoiding the risk of experiencing discomfort or falling down when retrieving his or her golf ball.

One example of the golf ball elevator in accordance with the present invention comprises a motorized telescoping shaft assembly. The motorized telescoping shaft assembly is preferably mounted to the webbing of a conventional golf hole cup. The telescoping shaft is coupled to a cylindrical cup element to receive and retain a golf ball stroked into the golf hole. The cylindrical cup element has an aperture through which a flagstick may be extended into the aperture in the webbing of a conventional golf hole cup incorporating the golf ball elevator. The cylindrical cup element is spring mounted to a plate which is attached to the telescoping shaft and also has an aperture through which the flagstick may be extended into the aperture in the webbing of the conventional golf hole cup incorporating the golf ball elevator. An electrical switch is mounted to the plate and is actuated when the weight of a golf ball in the cylindrical cup element causes the springs to be compressed to actuate the motor of the motorized telescoping shaft assembly to elevate the cylindrical cup element containing the golf ball until the telescoping shaft is fully extended. The golfer may then conveniently and comfortably remove his or her golf ball from the cylindrical cup element.

When the golfer removes the golf ball from the cylindrical cup element, the electrical switch which is actuated by the weight of the golf ball is deactuated so that the motor is actuated to reverse and lower the spring mounted cylindrical cup element and plate assembly to return the assembly into the golf hole cup.

In accordance with a second example, the golf ball elevator incorporated into the golf hole cup comprises a cylindrical shaft which may, for example, be three feet in length, coupled to a motor housed in a golf hole cup to move the shaft up and down along a coaxial rod interior of the cylindrical shaft. The exterior of the cylindrical shaft has gear teeth along the length of the shaft. The golf hole cup comprises a cylindrical cup element to receive and retain a golf ball stroked into the golf hole. The cylindrical cup element has an aperture through which a flagstick may be extended into the aperture in the webbing of a conventional golf hole cup incorporating the golf ball elevator. The cylindrical cup element is spring mounted to a plate which is attached to the shaft and also has an aperture through which the flagstick may be extended into the aperture in the webbing of the conventional golf hole cup incorporating the golf ball elevator. An electrical switch is mounted to the plate and is actuated when the weight of a golf ball in the cylindrical cap element causes the springs to be compressed to actuate the motor to drive a gear connected to the shaft of the motor and meshed with the gear teeth along the cylindrical shaft to elevate the cylindrical cup element containing the golf ball until a limit switch deactuates the motor when the cylindrical shaft is fully extended. The golfer may then conveniently and comfortably remove his or her golf ball from the cylindrical cup element.

When the golfer removes the golf ball from the cylindrical cup element the electrical switch which is actuated by the weight of the golf ball is deactuated so that the motor is actuated to reverse rotation of the gear connected to its shaft and lower the spring mounted cylindrical cup element and plate assembly to return the assembly into the golf hole cup.

In accordance with yet another example, the gear assembly of the second example may be replaced by a pulley assembly to raise and lower the cylindrical cup element and plate assembly.

BRIEF DESCRIPTION OF THE DRAWING

The various examples of the present invention will be described in conjunction with the accompanying figures of the drawing to facilitate an understanding of the present invention. In the drawing.

DETAILED DESCRIPTION OF THE PREFERRED EXAMPLE EMBODIMENTS

Figure 1:
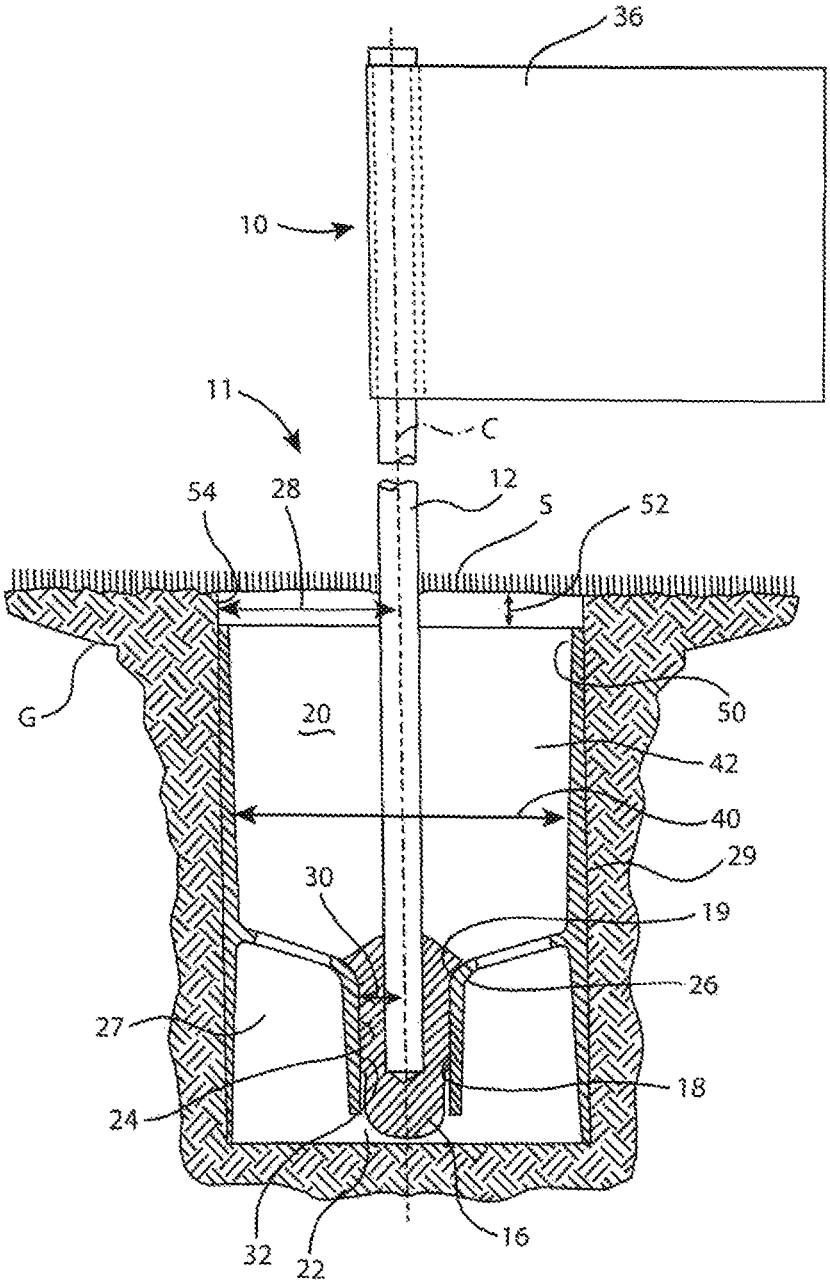
FIG. 1 PRIOR ART
FIG. 1 is a cross-sectional view of a conventional golf course flag and golf hole cup assembly.
Figure 2:
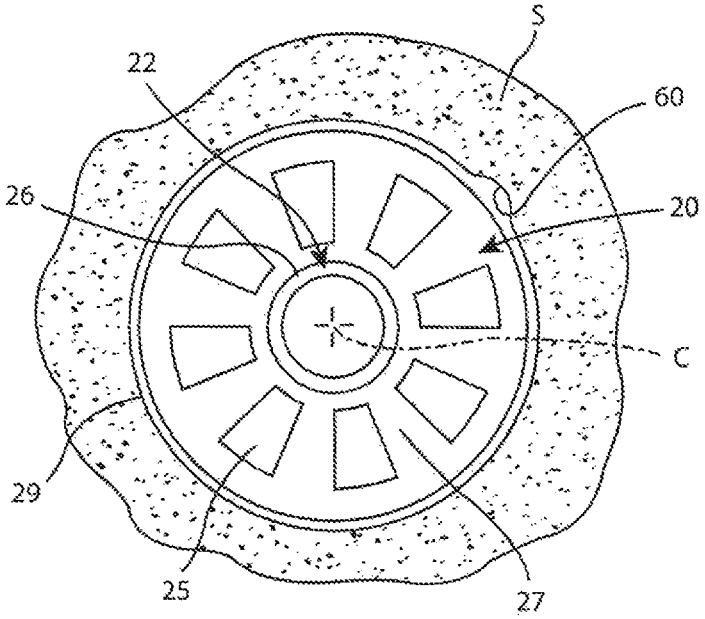
PRIOR ART FIG. 2
FIG. 2 is a top elevational view of a conventional golf hole cup.

FIGS. 1 and 2 are described above. FIGS. 1 and 2 illustrate the prior art as represented by a conventional USGA golf hole cup.

Figure 3:
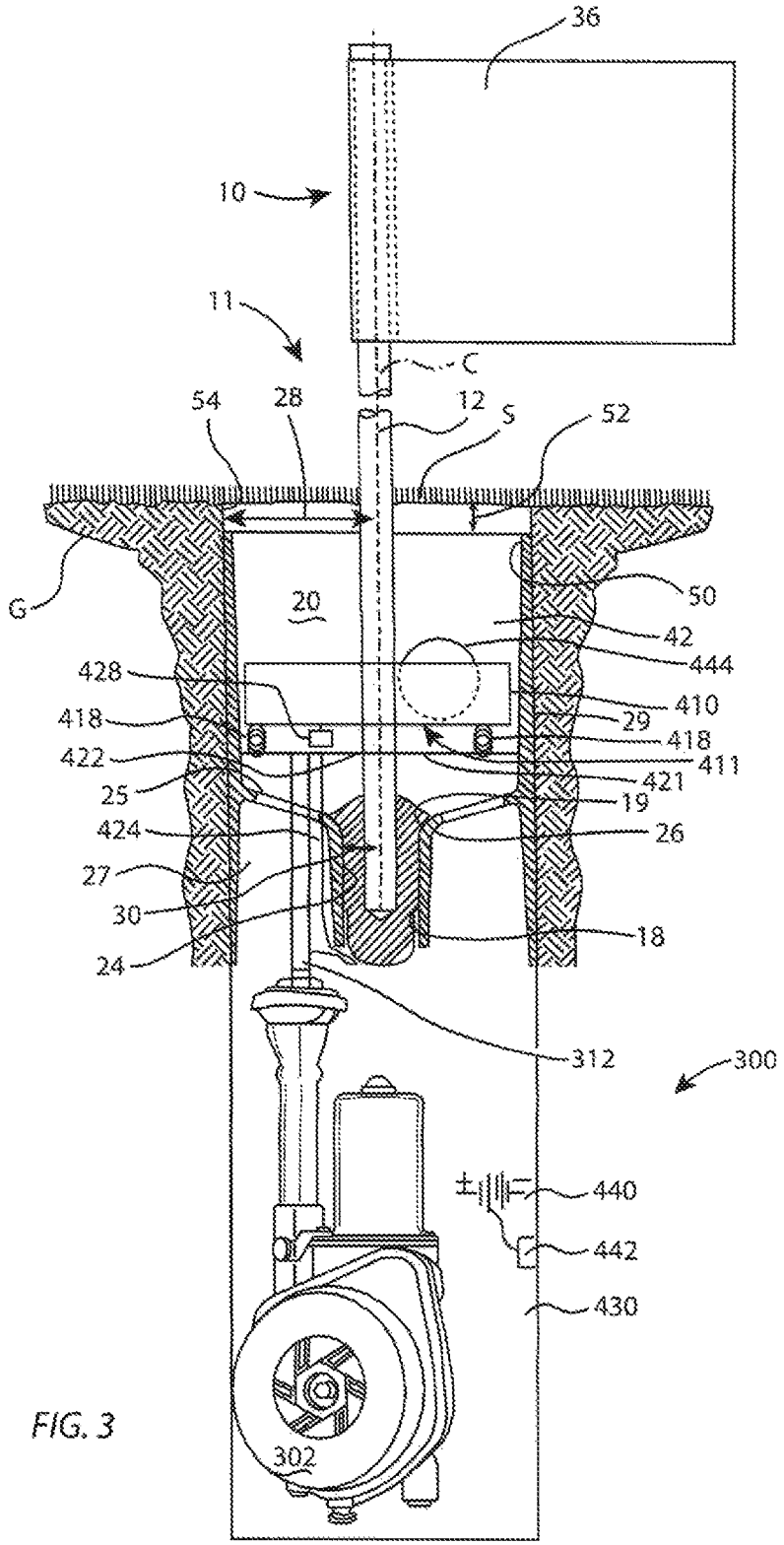
FIG. 3 is a perspective view of a golf ball elevator in accordance with a preferred example of the present invention.

FIG. 3 is a perspective view of the golf ball elevator in accordance with a preferred example of the present invention. FIG. 3 shows a golf ball elevator assembly 300 which is portable from one location of golf hole 11 to another (from place to place) on a golf course putting green. The golf ball elevator assembly 300 preferably comprises a rechargeable battery(ies) 440 to be charged before a round of golf is played so that the charge will be sufficient to last an entire day of golf. The battery(ies) 440 may be charged through an electrical connector 442, which can be plugged into a battery charger connected to a source of electrical power, such as an electrical outlet (not shown). Alternatively, the battery(ies) 440 can be charged using electrical power produced by solar cells (solar power).

As shown in FIG. 3, the golf ball elevator assembly 300 comprises a motorized telescoping shaft assembly 302 having a telescoping shaft 312 which can be driven up and down. That is, the motorized telescoping shaft assembly 302, which is powered by the battery(ies) 440 is transferred to the telescoping shaft 312, raising or lowering the telescoping shaft. The motorized telescoping shaft assembly 302 may be mounted to the conventional golf hole cup 20 such that the telescoping shaft 312 may extend through one of the voids 25 in the webbing structure of the conventional golf hole cup.

The golf ball elevator assembly 300 also comprises a cylindrical cup element 410 to receive and retain a golf ball 444 stroked into the golf hole 11. The cylindrical cup element 410 has an aperture 411 through which the flagstick 12 may be extended into the aperture 22 of the conventional golf ball cup 20 shown in FIG. 2. The cylindrical cup element 410 is mounted by springs 418 to a plate 421 which is attached to the telescoping shaft 312. The plate 421 has an aperture 422 through which the flagstick 12 may be extended into the aperture 22.

An electrical switch 428 connected to the motorized telescoping shaft assembly 302 by electrical wiring 424 is mounted to the plate 421 and is actuated when the weight of the golf ball 444 in the cylindrical cup element 410 causes the springs 418 to be compressed to actuate the motorized telescoping shaft assembly to elevate the cylindrical cup element containing the golf ball until the motorized telescoping shaft assembly is deactuated when the telescoping shaft 312 is fully extended.

The springs 418 have a spring constant equivalent to the tension force of the weight of the golf ball 444. Consequently, when a golfer strokes his or her golf ball 444 into the golf hole 11, the springs 418 are compressed to actuate the switch 428 to cause the motorized telescoping shaft assembly 302 to raise the cylindrical cup element 410 containing the golf ball 444 three or four feet or any comfortable height with the aid of the shaft 312. For example, the cylindrical cup element 410 containing the golf ball 444 may be elevated to a distance which is preferably three feet above the surface of the putting green. The golfer may then conveniently and comfortably remove his or her golf ball 444 from the cylindrical cup element 410. When the golfer removes his or her golf ball 444 from the cylindrical cup element 410, the springs 418 are in tension, and the switch 428 is switched so that the motorized telescoping shaft assembly 302 is actuated to lower the cylindrical cup element 410 and plate 421 assembly with the aid of the telescoping shaft 312.

As shown in FIG. 3, the golf ball elevator assembly 300 comprises the housing 430 which is portable and can be moved to any putting green or to different locations on a putting green of a golf course. The motorized telescoping shaft assembly 302 and battery(ies) 440, are preferably mounted in the housing 430 for waterproof protection and portability.

Because the shaft 312 can be telescopic, the length of the golf ball elevator assembly 300 can be approximately one foot. This enables the golf ball elevator assembly 300 to be portable for use on golf courses. The motorized telescoping shaft assembly 302 can be implemented by modifying a motorized antenna module such as shown in U.S. Pat. No. 4,236,162 or a commercially available Model PA-03 fully automatic "mini" power antenna marketed by Retro Manufacturing, LLC, located in Henderson, Nev.

Figure 4:
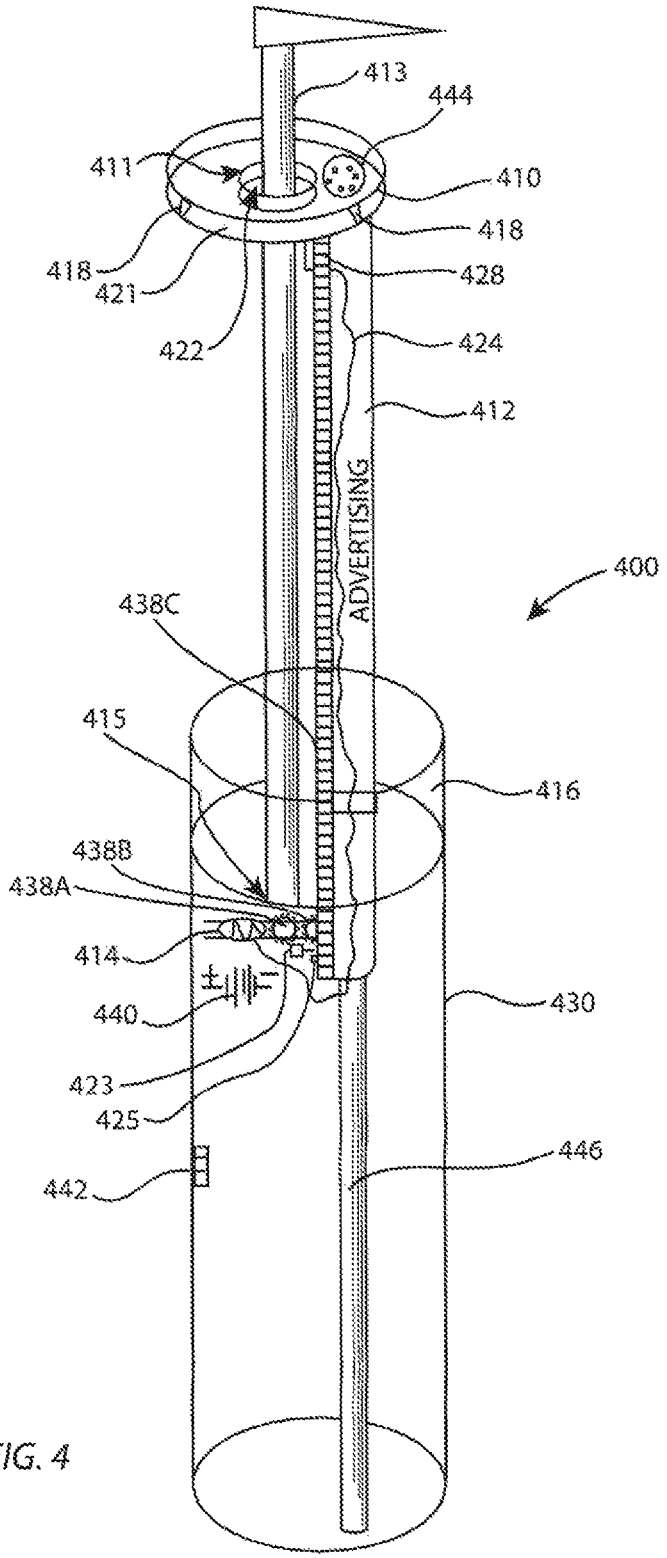
FIG. 4 is a perspective view of a golf ball elevator in accordance with an alternative example of the present invention.

FIG. 4 is a perspective view of the golf ball elevator in accordance with an alternative example of the present invention. FIG. 4 shows a golf ball elevator assembly 400 which is portable from one location of the golf hole 416 to another (from place to place) on a putting green. The golf ball elevator assembly 400 preferably comprises a rechargeable battery(ies) 440, to be charged before a round of golf is played so that the charge will be sufficient to last an entire day of golf. The battery(ies) 440 may be charged through an electrical connector 442, which can be plugged into a battery charger connected to a source of electrical power, such as an electrical outlet (not shown). Alternatively, the battery(ies) 440 can be charged using electrical power produced by solar cells (solar power).

As shown in FIG. 4, the shaft of a motor 414 is connected to a gear 438A. A shaft 412 has gear teeth 438C formed along the length of the shaft. The gear 438A is coupled to the gear teeth 438C by a gear 438B. For example, the gear 438B may be a worm wheel utilized to couple the gear 438A and the gear teeth 438C formed along the length of the shaft 412 so that the shaft can be driven up and down. That is, the motor 414 has the gear 438A, and the shaft 412 has gear teeth 438C coupled by the worm wheel 438B, so that rotation of the shaft of the motor 414, which is powered by the battery(ies) 440, is transferred to the shaft 412, raising or lowering the shaft 412.

As shown in FIG. 4, the shaft 412 may be cylindrical. A rod 446 mounted to the base of a housing 430 extends interior of the cylindrical shaft 412. The rod 446 constrains the movement of the shaft 412 to be rectilinear alone the length of the rod 446.

The golf ball elevator assembly 400 also comprises a cylindrical cup element 410 to receive and retain a golf ball 444 stroked into the golf hole 416. The cylindrical cup element 410 has an aperture 411 through which a flagstick 413 may be extended into an aperture 415 which is preferably the same as the aperture 22 of the conventional golf hole cup 20 shown in FIG. 2. The cylindrical cup element 410 is mounted by springs 418 to a plate 421 which is attached to the shaft 412. The plate 421 has an aperture 422 through which the flagstick 413 may be extended into the aperture 415.

An electrical switch 428 connected to the motor 414 by electrical wiring 424 is mounted to the plate 421 and is actuated when the weight of the golf ball 444 in the cylindrical cup element 410 causes the springs 418 to be compressed to actuate the motor 414 to drive the gear 438A connected to the shaft of the motor and meshed with the worm wheel 438B which in turn is meshed with the gear teeth 438C along the length of the shaft 412 to elevate the cylindrical cup element containing the golf ball until a limit switch 423 actuated by a projection 425 at the base of the shaft deactuates the motor when the shaft is fully extended.

The springs 418 have a spring constant equivalent to the tension force of the weight of the golf ball 444. Consequently, when a golfer strokes his or her golf ball into the golf hole 416, the springs 418 are compressed to actuate the switch 428 that causes the golf ball elevator assembly 400 to raise the cylindrical cup element 410 containing the golf ball 444 three or four feet or any comfortable height with the aid of the shaft 412. For example, the cylindrical cup element 410 containing the golf ball 444 may be elevated to a distance which is preferably three feet above the surface of the putting green. The golfer may then conveniently and comfortably remove the golf ball 444 from the cylindrical cup element 410. When the golfer removes his or her golf ball 444 from the cylindrical cup element 410, the springs 418 are in tension, and the switch 428 is switched so that the motor 414 is actuated to lower the cylindrical cup element 410 and plate 421 assembly with the aid of the shaft 412.

As shown in FIG. 4, the components of the golf ball elevator assembly 400 comprise the housing 430 which is portable and can be moved to any putting green or to different locations on a putting green of a golf course. The motor 414, battery(ies) 440, gear assembly 438A-C, limit switch 423, shaft 412, and rod 446 are preferably mounted in the housing 430 for waterproof protection while maintaining portability.

The golf ball elevator assembly 400 including the housing 430 can be constructed from any kind or combination of materials, for example, metal or plastic or any other materials that are suitable. Preferably, materials are selected which are lightweight so that the golf ball elevator assembly 400 can be easily carried and moved around. With the golf ball elevator assembly 400 shown in FIG. 4, there is no change to the golf course above ground. The hole 416 in the putting green is made to accommodate the golf ball elevator assembly 400. A deeper cylindrical hole 416 can be made the diameter of golf hole cup 416 to a depth of three to four feet under the surface of the golf course to accommodate the housing 430.

Figure 5:
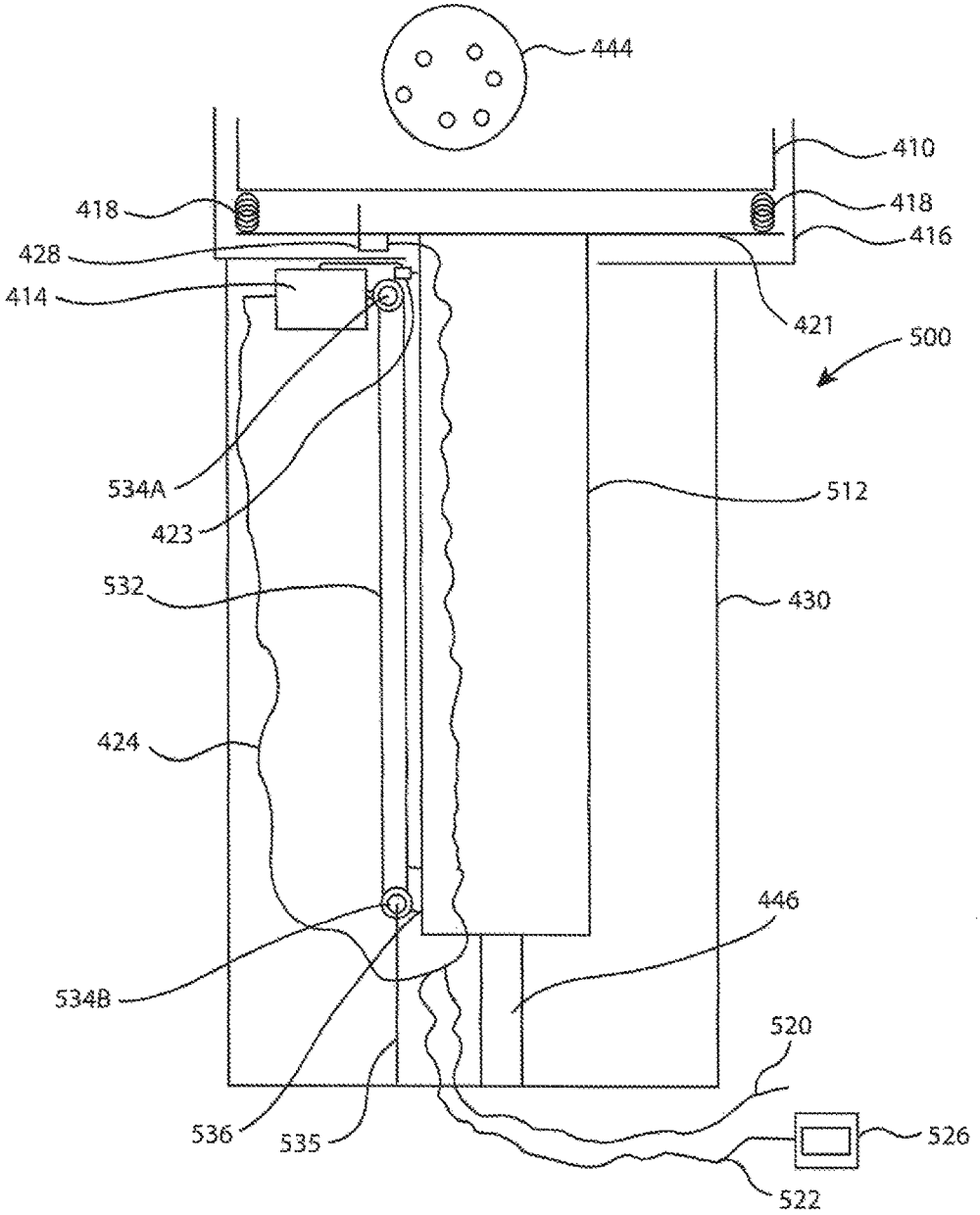
FIG. 5 is a perspective view of a golf ball elevator in accordance with another alternative example of the present invention.

FIG. 5 shows another alternative example of a golf ball elevator assembly 500. The golf ball elevator assembly 500 comprises the cylindrical cup element 410 to receive and retain the golf ball 444 stroked into the golf hole 416. The cylindrical cup element 410 is mounted by the springs 418 to the plate 421 which is attached to a shaft 512. The switch 428 is mounted to the plate 421 and is connected by the electrical wiring 424 to the motor 414. The plate 421 is attached to the shaft 512 within which the rod 446 extends.

As shown in FIG. 5, the shaft of the motor 414 is attached to a pulley 534A. The pulley 534A is coupled by a belt or cable 532 to a pulley 534B mounted to a mast 535 mounted to and extending from the bottom of the housing 430. A cleat 536 connects the shaft 512 to the belt or cable 532 to move the shaft to raise and lower the cylindrical cup element 410 and plate 412 assembly.

The electrical switch 428 connected to the motor 414 by electrical wiring 424 is mounted to the plate 421 and is actuated when the weight of the golf ball 444 in the cylindrical cup element 410 causes the springs 418 to be compressed to actuate the motor to drive the pulley 534A connected to the shaft of the motor coupled by the belt or cable 532 to the pulley 534B to elevate the cylindrical cup element containing the golf ball until the limit switch 423 is actuated by the cleat 536 to deactuate the motor when the shaft 512 is fully extended.

The springs 418 have a spring constant equivalent to the tension force of the weight of the golf ball 444. Consequently, when a golfer strokes his or her golf ball into the golf hole 416, the springs 418 are compressed to actuate the switch 428 that causes the golf ball elevator assembly 400 to raise the cylindrical cup element 410 containing the golf ball 444 three or four feet or any comfortable height with the aid of the shaft 512. For example, the cylindrical cup element 410 containing the golf ball 444 may be elevated to a distance which is preferably three feet above the surface of the putting green. The golfer may then conveniently and comfortably remove the golf ball 444 from the cylindrical cup element 410. When the golfer removes his or her golf ball 444 from the cylindrical cup element 410, the springs 418 are in tension, and the switch 428 is switched so that the motor 414 is actuated to lower the cylindrical cup element 410 and plate 421 assembly with the aid of the shaft 512 coupled to the belt or cable 532 driven by the pulleys 534A and 534B. Preferably, all of the components are mourned in the housing 430 for waterproof protection and portability.

As shown in FIG. 5, the motor 414 can be connected by wiring 520 to a power source such as an electrical power outlet (not shown), instead of a battery(ies) to supply power to the motor 414. Also, a computer cable 522 can extend through the housing 430 to connect a processor (CPU) 526 to the motor 414. The golf ball elevator assembly 500 can be connected to all eighteen holes with electrical wiring 520 and computer cable 522 to the CPU 526. When a golfer scores, the shaft 512 is raised three to four feet. This makes it easy for other golfers and fans in an audience to know that the golfer scored, because many spectators are far away from the hole.

The various examples of the golf ball elevator in accordance with the present invention have many advantages. The golf ball elevator including the motorized telescoping shaft 312 or the motor 414 and shaft 412 or 512 enable a golfer to retrieve his or her golf ball easily at a comfortable height, reducing the risk of stumbling and/or falling down when retrieving the golf ball from the golf hole cup.

Additionally, the golf ball elevator in accordance with the present invention can be installed on all golf course holes, and all of the eighteen holes can be connected to each other with electrical wiring 520 and computer cable 522 connected to a main CPU 526 to track play on the golf course and control advertising, displaying a company name and logo or other branding, or messaging. The golf ball elevator incorporated into the golf hole cup being the prime spot of the golf course to focus all eyes from fans makes this the prime location for advertising and/or messaging with the aid of the golf ball elevator. In accordance with one example, the golf ball elevator can be utilized as a sign board for advertising when in the raised position. In accordance with another example, the golf ball elevator can incorporate a digital display element mounted to the shaft 312, 412, or 512 which can be computer controlled to display digital images. For example, the shaft 412 or 512 can be formed with four sides (square) having digital displays to facilitate digital images used for advertising when in the raised position. Additionally, a loudspeaker can be incorporated into the golf ball elevator, and the CPU 526 can supply the loudspeaker with audio for music before and after the golf match, for example, the fourth of July and Christmas, and/or broadcast announcements during the golf match.

Also, the shaft 312, 412, or 512 can incorporate a computer controlled display to display which score was achieved by the golfer who stroked his or her golf ball into the golf hole cup, e.g., a hole in one, eagle, birdie, bogie, double bogie, etc. The computer controlled display incorporated into the shaft 312, 412, or 512 can also display images to instruct how to play the game of golf so that spectators and viewers of televised tournaments can more easily understand golf.

The examples described above are provided by way of example only, and various modifications which will be apparent to persons skilled in the art are contemplated. For example, the golf ball elevator may be powered by a pneumatic motor or hydraulic motor. Also, the golf ball elevator may alternatively be remotely controlled by computer. Accordingly, the scope of the present invention can only be ascertained with reference to the appended claims.

What is claimed is:

1. A system to facilitate retrieval of a golf ball after the ball is stroked by a golfer into a cylindrical golf hole cup comprising a webbing structure formed by web elements projecting inwardly from an inner cylindrical cup wall and having voids formed between the web elements and comprising a center cylindrical aperture formed in the webbing structure to retain a flagstick assembly wherein the flagstick assembly comprises a ferrule that may be slid into and out of the center cylindrical aperture, the system comprising:

a golf ball elevator mounted to the golf hole cup, comprising:

a motorized telescoping shaft assembly, the motorized telescoping shaft assembly having a telescoping shaft and a motor coupled to the telescoping shaft;

a cylindrical cup element to receive and retain a golf ball stroked into the golf hole cup, the cylindrical cup element having an aperture through which the ferrule of the flagstick assembly may be extended into the center cylindrical aperture formed in the webbing structure to retain the flagstick assembly in the golf hole cup;

a plate attached to the telescoping shaft, wherein the telescoping shaft extends through one of the voids in the webbing structure for attachment to the plate the plate having an aperture through which the ferrule of the flagstick assembly may be extended into the center cylindrical aperture formed in the webbing structure to retain the flagstick assembly in the golf hole cup;

at least one spring interconnected between the cylindrical cup element and the plate to mount the cylindrical cup element to the plate; and a switch mounted to the plate and connected to the motorized telescoping shaft assembly, wherein the switch is actuated when the weight of a golf ball in the cylindrical cup element causes the at least one spring to be compressed to actuate the switch to activate the motor to cause the motor to extend the telescoping shaft to raise the cylindrical cup element containing the golf ball until the telescoping shaft is fully extended and wherein the switch is deactuated when the golf ball is retrieved from the cylindrical cup element to cause the at least one spring to decompress to deactuate the switch to activate the motor to cause the motor to retract the telescoping shaft to lower the cylindrical cup element into the golf hole cup until the telescoping shaft is fully retracted; wherein the golf ball may fall into the cylindrical cup element while the flagstick assembly is retained in the golf hole cup; and wherein the motorized telescoping shaft assembly causes the aperture in the cylindrical cup element and the plate to move axially with respect to the flagstick assembly when the flagstick assembly is retained in the center cylindrical aperture of the golf hole cup without raising or lowering the flagstick assembly.

2. A system as recited in claim 1, further comprising at least one battery connected to the motorized telescoping shaft assembly to supply power to the motor.

3. A system as recited in claim 2 wherein the at least one battery is rechargeable, and further comprising a connector connected to the at least one battery and adapted to be coupled to a power source to supply power to charge the at least one battery.

4. A system as recited in claim 1, further comprising wiring connected to the motorized telescoping shaft assembly, wherein the wiring is connected to a power source to supply power to the motor.

5. A system as recited in claim 1, further comprising a processor connected to the motorized telescoping shaft assembly and at least one of a display and loudspeaker integrated with the telescoping shaft, and wherein the processor controls messaging produced by the display and sound produced by the loudspeaker.

6. A system as recited in claim 1, further comprising a housing, and wherein the golf ball elevator is mounted in the housing.

7. A system to facilitate retrieval of a golf ball after the ball is stroked by a golfer into a golf hole having a cylindrical golf hole cup installed therein comprising a webbing structure formed by web elements projecting inwardly from an inner cylindrical cup wall and having voids formed between the web elements and a center cylindrical aperture formed in the webbing structure to retain a flag stick assembly wherein the flagstick assembly comprises a ferrule that may be slid into and out of the center cylindrical aperture, comprising:

a golf ball elevator mounted in the golf hole, comprising:

a housing;

a motor mounted in the housing;

a rod mounted in the housing;

a shaft, wherein the rod is disposed in the interior of the shaft so that the shaft is mounted on the rod for rectilinear movement along the rod;

coupling means to couple the motor to the shaft to raise and lower the shaft;

a cylindrical cup element to receive and retain a golf ball stroked into the golf hole, the cylindrical cup element having an aperture through which the ferrule of the flagstick assembly may be extended into a center cylindrical aperture formed in the webbing structure to retain the flagstick assembly in the golf hole cup;

a plate attached to the shaft, wherein the shaft extends through one of the voids in the webbing structure for attachment to the plate the plate having an aperture through which the ferrule of the flagstick assembly may be extended into the center cylindrical aperture formed in the webbing structure to retain the flagstick assembly in the golf hole cup;

at least one spring interconnected between the cylindrical cup element and the plate to mount the cylindrical cup element to the plate; and a switch mounted to the plate and connected to the motor, wherein the switch is actuated when the weight of a golf ball in the cylindrical cup element causes the at least one spring to be compressed to actuate the switch to activate the motor to raise the cylindrical cup element containing the golf ball until the shaft is fully extended and wherein the switch is deactuated when the golf ball is retrieved from the cylindrical cup element to cause the at least one spring to decompress to deactuate the switch to activate the motor to lower the cylindrical cup element into the golf hole; wherein the golf ball may fall into the golf hole while the flagstick assembly is retained in the golf hole cup; and wherein the golf ball elevator causes the aperture in the cylindrical cup element and the plate to move axially with respect to the flagstick assembly when the flagstick assembly is retained in the center cylindrical aperture of the golf hole cup without raising or lowering the flagstick assembly.

8. A system as recited in claim 7, further comprising a limit switch, and wherein the motor is activated to elevate the cylindrical cup element containing the golf ball until the limit switch deactivates the motor when the shaft is fully extended and wherein the motor is activated to lower the cylindrical cup element when the golf ball is retrieved.

9. A system as recited in claim 7 wherein the motor has a motor shaft and the coupling means comprises gear teeth formed along a length of the exterior of the shaft, a gear connected to the motor shaft, and a worm wheel to couple the gear teeth formed along the length of the exterior of the shaft and the gear connected to the motor shaft, and further comprising a limit switch and a projection on the shaft to actuate the limit switch when the shaft is fully extended.

10. A system as recited in claim 7 wherein the motor has a motor shaft and the coupling means comprises a first pulley connected to the motor shaft, a mast mounted in the housing, a second pulley mounted to the mast, and a belt or cable to interconnect the first and second pulleys, and further comprising a limit switch and a cleat attached to the belt or cable to actuate the limit switch when the shaft is fully extended.

11. A system as recited in claim 7 wherein the golf ball elevator is integrated with the golf hole cup.

12. A system as recited in claim 7, further comprising at least one battery connected to the motor to supply power to the motor.

13. A system as recited in claim 12 wherein the at least one battery is rechargeable, and further comprising a connector connected to the at least one battery and adapted to be coupled to a power source to supply power to charge the at least one battery.

14. A system as recited in claim 7, further comprising wiring connected to the motor, wherein the wiring is connected to a power source to supply power to the motor.

15. A system as recited in claim 7, further comprising a processor connected to the motor and at least one of a display and loudspeaker integrated with the shaft, and wherein the processor controls messaging produced by the display and sound produced by the loudspeaker.

16. A system as recited in claim 15 wherein the shaft is cylindrical.

17. A system as recited in claim 15 wherein the shaft is square.

18. A system as recited in 5 wherein the messaging comprises advertising.

19. A system as recited in 15 wherein the messaging comprises advertising.

* * * * *